US007721666B1

(12) United States Patent
Sovel

(10) Patent No.: US 7,721,666 B1
(45) Date of Patent: May 25, 2010

(54) HULL-MOUNTED LINE RETRIEVAL AND RELEASE SYSTEM

(75) Inventor: James E. Sovel, Panama City Beach, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 496 days.

(21) Appl. No.: 11/973,985

(22) Filed: Sep. 25, 2007

(51) Int. Cl.
*B63B 17/00* (2006.01)
*B63B 21/00* (2006.01)
*B63B 21/04* (2006.01)

(52) U.S. Cl. ..... 114/218

(58) Field of Classification Search ..... 114/213–218, 114/221 R, 230.2–230.3, 380; 24/66.1, 66.2, 24/599.4–599.8; 294/82.19, 82.2, 82.27, 294/82.33
See application file for complete search history.

(56) References Cited

U.S. PATENT DOCUMENTS 482,885 A * 9/1892 Wallace ..... 24/599.1
612,194 A * 10/1898 Clough ..... 24/598.9
1,300,231 A * 4/1919 Sinclair ..... 294/82.19
6,421,888 B1 * 7/2002 Grenga et al. ..... 24/601.5
6,601,274 B2 * 8/2003 Gartsbeyn ..... 24/599.8
7,051,410 B2 * 5/2006 Simond ..... 24/600.9

* cited by examiner

*Primary Examiner*—Ajay Vasudeva
(74) *Attorney, Agent, or Firm*—James T. Shepherd

(57) ABSTRACT

A line retrieve-release system is provided for mounting on the hull of a boat. Jaws are coupled to the hull of the boat and face substantially aft relative to the boat's bow. The jaws are capable of movement between a partially open position defining the system's "line retrieve" position and a fully open position defining the system's "line release" position. A latch coupled to the jaws is biased to cooperate therewith in the partially open position to thereby define a first enclosed region bounded by the jaws and latch. The latch permits one-way entry into the first enclosed region when a force is applied to the latch from outside of the first enclosed region. Line catch means are coupled to the hull of the boat aft of the jaws. The line catch means combines with the jaws in their partially open position to define a second enclosed region adjacent to the first enclosed region. The line catch means permits one-way entry to the second enclosed region when a force is applied thereto from outside of the second enclosed region. Actuator element(s) are coupled to the jaws to move them to their fully open position to thereby open both the first and second enclosed regions. The actuator elements also allow the retrieve-release system to reset to its "line retrieve" position.

15 Claims, 2 Drawing Sheets

HULL-MOUNTED LINE RETRIEVAL AND RELEASE SYSTEM

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to the retrieval and releasing of floating lines from a floating vessel, and more particularly to a hull-mounted line retrieval and release system that can retrieve and capture a line floating at or near the water's surface and also release the line so-captured.

BACKGROUND OF THE INVENTION

A ship or other surface-floating vessel frequently must be able to deploy and/or retrieve a "line" (e.g., tow rope or cable, towed sensor array, mooring line, etc.) floating at or near the water's surface. For example, an autonomous ship/vessel is frequently deployed from a mother ship and recovered by a mother ship using a mechanism (mounted on the autonomous ship/vessel) that can automatically retrieve and release a line that is towed behind a mother ship. Given the prevalence of autonomous ships/vessels in the Navy, there is a need for a mechanism that can accomplish these tasks quickly and reliably.

SUMMARY OF THE INVENTION

Accordingly, it is an object of the present invention to provide a ship/vessel mounted system that can retrieve a line floating at or near the water's surface.

Another object of the present invention is to provide a ship/vessel mounted system that can retrieve and capture a line floating at or near the water's surface and also release the line so-captured.

Other objects and advantages of the present invention will become more obvious hereinafter in the specification and drawings.

In accordance with the present invention, a line retrieve-release system is provided for mounting on the hull of a boat. Jaws are coupled to the hull of the boat and face substantially aft relative to the boat's bow. The jaws are capable of movement between a partially open position and a fully open position. The partially open position defines the system's "line retrieve" position whereas the fully open position defines the system's "line release" position. A latch is coupled to the jaws and is biased to cooperate therewith in the partially open position to thereby define a first enclosed region bounded by the jaws and latch. The latch permits one-way entry into the first enclosed region when a force is applied to the latch from outside of the first enclosed region. A line catcher is coupled to the hull of the boat aft of the jaws. The line catcher combines with the jaws in their partially open position to define a second enclosed region adjacent to the first enclosed region and separated therefrom by the latch. The line catcher permits one-way entry to the second enclosed region when a force is applied thereto from outside of the second enclosed region. Actuator element(s) are coupled to the jaws to move them to their fully open position to thereby open both the first and second enclosed regions.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
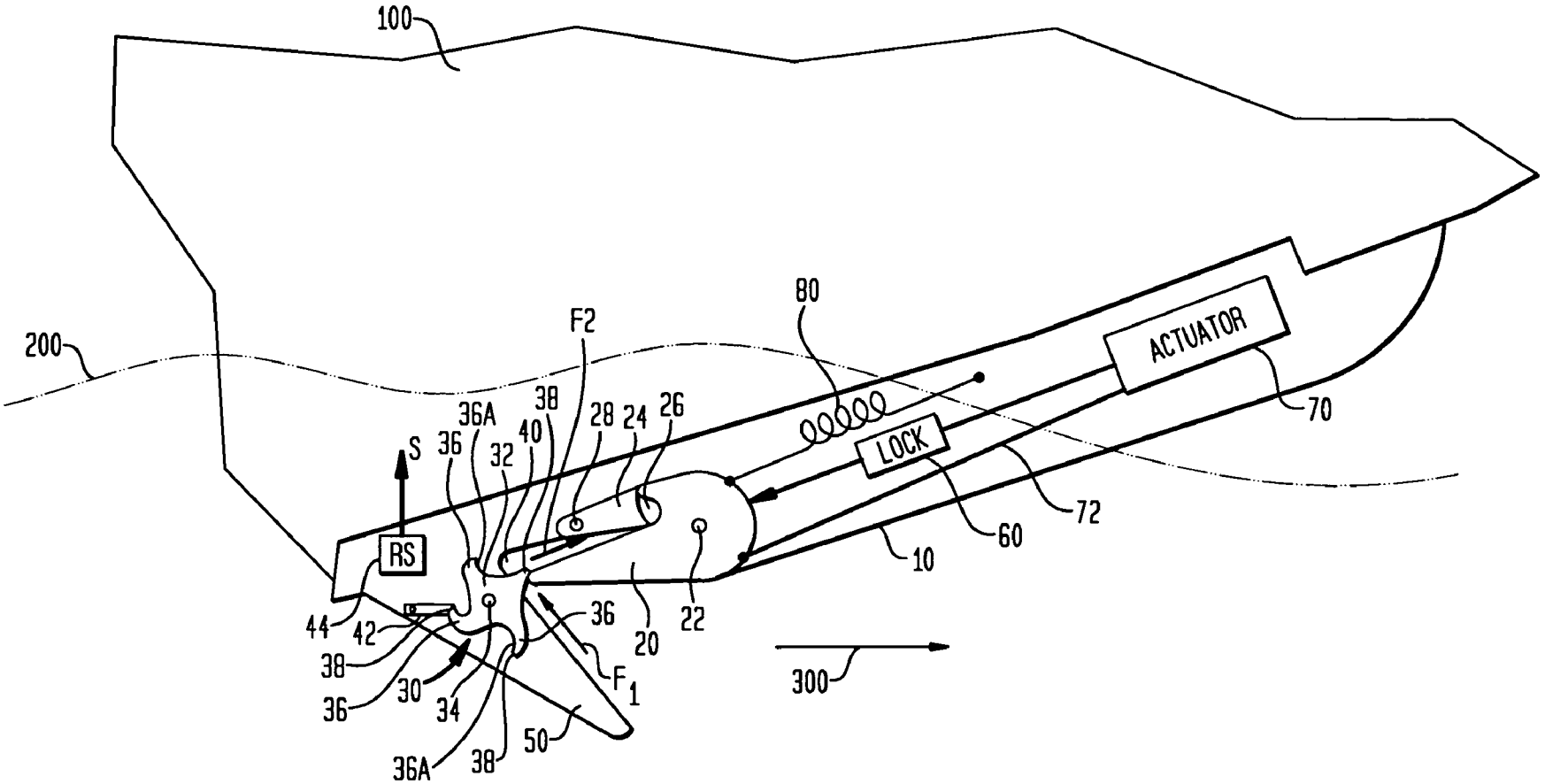
FIG. 1 is a part perspective view and part schematic view of a line retrieve-release system attached to a boat hull where the system is illustrated in its ready-to-retrieve and line-captured position in accordance with an embodiment of the present invention.

Referring now to the drawings and more particularly to FIG. 1, a portion of surface-floating vessel hull is referenced by numeral 100. By way of illustration the portion of hull 100 is the vessel's bow that sits just above and below the water's surface designated by the dashed line referenced by numeral 200. While the illustrated embodiment of the inventive line retrieve/release system is mounted on the bow portion of hull 100 that is just below surface 200, it is to be understood that this system could be mounted on other portion's of a vessel's hull without departing from the scope of the present invention.

The present line retrieve/release system has a support frame or housing 10 that is mounted to hull 100. Housing 10 provides the support and mounting framework for the components of the line retrieve/release system used to retrieve a line (not shown) floating at or near surface 200 when hull 100 is moving in a forward direction that is indicated by arrow 300. The term "forward" as used herein refers to vessel movement that leads with the bow portion of hull 100.

An arm 20 is pivotally coupled to housing 10 using, for example, a pin 22 that allows rotation of arm 20 in a two-dimensional plane of rotation so that the combination of housing 10 and arm 20 define jaws. Arm 20 points substantially towards the rear of hull 100, i.e., substantially opposite to forward direction 300. Coupled to housing 10 is a spring latch 24 that is spring-biased to cooperate with (e.g., contact) arm 20 such that an enclosed line capture region 26 is defined by arm 20 and latch 24. In the illustrated embodiment, arm 20 is C-shaped where defining its portion of capture region 26 to facilitate line release action as will be explained further below. Note that depending on the shape of arm 20 at capture region 26, housing 10 could also define a portion of capture region 26. In the illustrated embodiment, spring latch 24 is pivotally mounted to housing 10 using, for example, a pin 28 with spring latch 24 being spring-biased to contact arm 20 as shown.

Mounted aft of arm 20 is a rotating multi-arm spinner or paddle wheel 30 that spins in the same two-dimensional plane of rotation as arm 20. More specifically, paddle wheel 30 is defined by a central hub portion 32 that is mounted to housing 10 via a pin 34 such that paddle wheel 30 can rotate or spin. Extending in a radial fashion out from hub portion 32 in the paddle wheel's plane of rotation are a plurality of blades or paddles 36. While four paddles 36 are illustrated, the present invention is not so limited as more or fewer paddles can be used without departing from the scope of the present invention. Typically, paddles 36 are evenly spaced about the periphery of hub portion 32. Each of paddles 36 can be concavely or C-shaped at one face thereof (as indicated by reference numeral 36A) for reasons that will be explained later below. Paddle wheel 30 is sized/positioned such that each of the outer ends or tips 38 of paddles 36 can cooperate with the outboard end 20A of arm 20 when a paddle 36 is aligned with arm 20 in its partially open position as shown. As a result of such paddle 36/arm 20 cooperation, a capture region 40 is defined and bounded by housing 10, arm 20, latch 24 and paddle wheel 30. Capture region 40 is aft of and adjacent to capture region 26 with the two capture regions being separated by latch 24.

Briefly, when hull 100 is moving through the water in forward direction 300, the force of the oncoming flow of water (designated by $F_1$) causes paddle wheel 30 to rotate in a counter-clockwise direction. The counter-clockwise rotation of paddle wheel 30 creates capture region 40 when a paddle tip 38 cooperates with arm 20 as shown in FIG. 1. However, when paddle wheel 30 is positioned such that no paddle tip 38 is in contact with arm 20, an entry into capture region 40 is provided. For reasons that will be explained further below, paddle wheel 30 is inhibited from complete clockwise rotation but is permitted to partially rotate in a clockwise direction. To accomplish this, a one-way rotation lock 42 is coupled to housing 10 adjacent paddle wheel. From a functional perspective, lock 42 allows paddle wheel 30 to fully rotate in a counter-clockwise direction, but only rotate clockwise an angular distance defined essentially by the angular separation between two adjacent ones of paddles 36. Accordingly, lock 42 can be realized by a simple spring-loaded lever cooperating with paddle tips 38 as would be well understood in the art. Lock 42 could also be configured to cooperate with other attributes (e.g., tabs, notches, etc.) provided on paddle wheel 30 without departing from the scope of the present invention.

A rotation sensor ("RS") 44 is also provided to determine if/when paddle wheel 30 is not rotating. Rotation sensor 44 can be an electromechanical or optical apparatus without departing from the scope of the present invention. Briefly, during a line capture operation, paddle wheel 30 will cease rotation when a line is captured. Sensor 44 generates a signal "S" in response to such rotation cessation. As will be explained further below, signal S can be used to trigger manual or automated operations that ensure the retention of the line that was captured.

To direct an oncoming flow of water to paddle wheel 30, a water deflector 50 can be mounted to housing 10. Deflector 50 extends forward of paddle wheel 30 and away from hull 100. Deflector 50 can also serve as the initial contact point for a line (not shown) that is to be retrieved by the present invention.

FIG. 1 illustrates the present invention in its "ready-to-retrieve" and "line capture" position. That is, in this illustrated position, the present invention is poised to retrieve and capture a line (not shown) when hull 100 is moving in forward direction 300. To maintain the present invention in this position, rotational movement of arm 20 must be inhibited. By way of example, such rotational movement inhibition can be achieved with a spring-loaded lock mechanism 60 cooperating with arm 20 as shown. However, it is to be understood that such rotational movement inhibition could be accomplished in a variety of ways without departing from the scope of the present invention.

With the present invention in the position illustrated in FIG. 1, a line (not shown) can be retrieved/captured when hull 100 is moving in forward direction 300. Specifically, when hull 100 is moving in forward direction 300, paddle wheel 30 is driven to counter-clockwise rotation under force $F_1$. A line (not shown) floating at/near water surface 200 and crossing the path of such forward movement is eventually engaged by housing 10 or deflector 50 depending on the depth of the line. As a result, housing 10 or deflector 50 facilitates the guidance of the line towards paddle wheel 30 where the line will engage a shaped face 36A of one of paddles 36. The continued counter-clockwise rotation of paddle wheel 30 (caused by the force $F_1$ of the oncoming water as well as the force of the line engaged by paddle wheel 30 as hull 100 moves in forward direction 300) causes the line to be admitted into capture region 40.

As hull 100 continues in forward direction 300 with a line in capture 40, the line will tend to be driven into the aft most portion of capture region 40 thereby inhibiting further counter-clockwise rotation of paddle wheel 30. To insure the continual retention of the line under higher loads, the present invention is configured to next cause the captured line to be admitted into capture region 26 as follows. When paddle wheel 30 is no longer rotating in a counter-clockwise direction, signal S is generated by sensor 44. In response to signal S, a boat operator or automatic boat control system slows the speed of the vessel in forward direction 300. The resulting change in forward momentum causes (i) paddle wheel 30 to now rotate in a clockwise direction by an angular amount permitted by rotation lock 42, and (ii) the captured line to tend to move towards capture region 26. The partial clockwise rotation of paddle wheel 30 combined with the momentum change acting on the line in capture region 40 will cause the line to be pushed up against latch 24 and apply a force thereto indicated by force $F_2$. As force $F_2$ overcomes the spring bias of latch 24, the line is admitted into capture region 26 and latch 24 is biased back into contact with arm 20.

Figure 2:
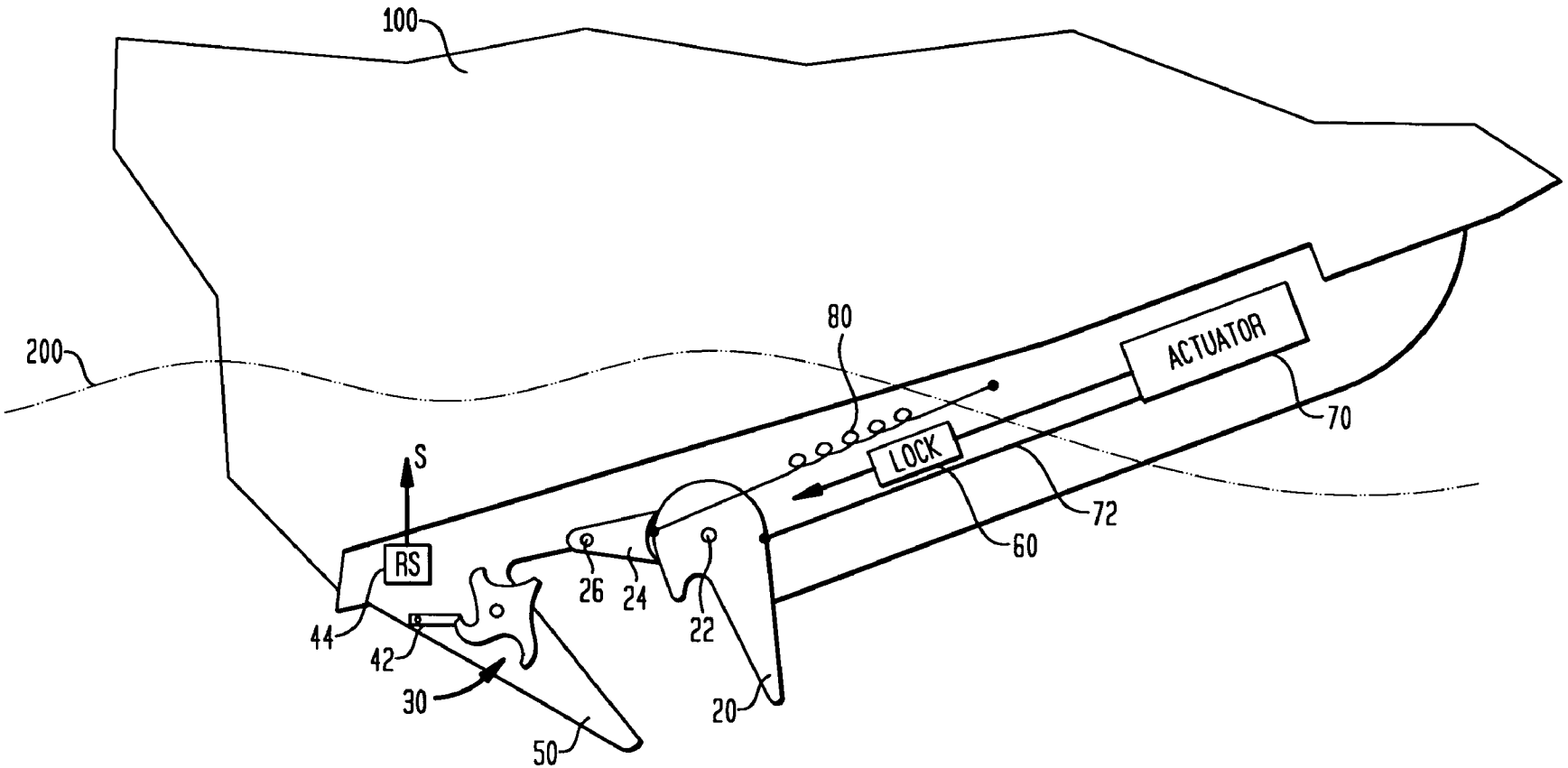
FIG. 2 is a part perspective view and part schematic view of the line retrieve-release system illustrated in its line released position.

To release a line retrieved and retained as just described, a simple release mechanism is provided to release the line retained in capture region 26. An actuator 70 is coupled to lock mechanism 60 and also to arm 20 via a rod or cable 72. Lock mechanism 60 is representative of any mechanism that can engage arm 20 to prevent rotation thereof and be disengaged from arm 20 to allow rotation thereof. Referring additionally now to FIG. 2, the release of a captured line will be explained. Hull 100 can be stationary or moving during line release. To begin the line release process, actuator 70 first acts on lock mechanism 60 to unlock or disengage it from arm 20 as shown so that rotational movement of arm 20 is no longer inhibited. Next, actuator 70 pulls on cable 72 to thereby rotate arm 20 in a counter-clockwise fashion until capture regions 26 and 40 are opened to no longer exist as shown in FIG. 2. In the illustrated embodiment, the C-shaped region of arm 20 that defines a portion of capture region 26 helps to push a line therefrom when arm 20 is rotated by actuator 70/cable 72.

Once a line has been released, the present invention is returned to its "ready-to-retrieve" position (FIG. 1). This can be achieved by reversing the tension in rod/cable 72 so that arm 20 is rotated in a clockwise fashion. This process can also be aided or alternatively achieved by means of a spring 80 coupled to housing 10 and arm 20 as shown. More specifically, line release movement of arm 20 would place spring 80 in tension where such spring tension would then be used to return arm 20 back to its "ready-to-retrieve" position. Once back in this position, lock mechanism 60 could again be actuated by actuator 70 (or could be spring biased) to engage and lock arm 20 in its "ready-to-retrieve" position.

The advantages of the present invention are numerous. A floating line can be retrieved/released by a simple mechanism mounted on a vessel's hull. The present invention incorporates an enhanced line retention mechanism that insures a retrieved line will be retained until the line is to be released.

The use of a spinning paddle wheel provides reliable line capture in the forward direction. The entry of the line into the mechanism is facilitated by the hydro-dynamically powered paddle wheel thereby eliminating the need for the line to exert a force to enter the capture region.

Although the invention has been described relative to a specific embodiment thereof, there are numerous variations and modifications that will be readily apparent to those skilled in the art in light, of the above teachings. It is therefore to be understood that, within the scope of the appended claims, the invention may be practiced other than as specifically described.

What is claimed as new and desired to be secured by Letters Patent of the United States is:

1. A line retrieve-release system mounted on a hull of a boat, comprising:

jaw means configured for attachment to the hull of the boat and facing substantially aft relative to the bow of the boat, said jaw means being capable of movement between a partially open position and a fully open position;

a latch coupled to said jaw means and biased to cooperate therewith in said partially open position thereof to thereby define a first enclosed region bounded by said jaw means and said latch, said latch permitting one-way entry to said first enclosed region when a force is applied to said latch from outside of said first enclosed region;

line catch means configured for attachment to the hull of the boat aft of said jaw means, said line catch means combining with said jaw means in said partially open position to define a second enclosed region adjacent to said first enclosed region and separated therefrom by said latch, said line catch means permitting one-way entry to said second enclosed region when a force is applied thereto from outside of said second enclosed region; and actuator means coupled to said jaw means for moving said jaw means to said fully open position to thereby open said first enclosed region and said second enclosed region.

2. A line retrieve-release system as in claim 1 wherein said actuator means includes a locking mechanism for locking said jaw means in said partially open position.

3. A line retrieve-release system as in claim 1 wherein said actuator means includes a return mechanism for returning said jaw means to said partially open position from said fully open position.

4. A line retrieve-release system as in claim 1 wherein said actuator means comprises:

a locking mechanism for locking said jaw means in said partially open position; and an actuator coupled to said locking mechanism and said jaw means for sequentially (i) unlocking said locking mechanism, and (ii) moving said jaw means to said fully open position.

5. A line retrieve-release system as in claim 4 wherein said actuator means further includes a return mechanism for returning said jaw means to said partially open position from said fully open position.

6. A line retrieve-release system mounted on a hull of a boat, comprising:

jaw means to the hull of the boat and facing substantially aft relative to the bow of the boat, said jaw means being capable of movement between a partially open position and a fully open position;

a latch coupled to said jaw means and biased to cooperate therewith in said partially open position thereof to thereby define a first enclosed region bounded by said jaw means and said latch, said latch permitting one-way entry to said first enclosed region when a force is applied to said latch from outside of said first enclosed region;

line catch means to the hull of the boat aft of said jaw means, said line catch means combining with said jaw means in said partially open position to define a second enclosed region adjacent to said first enclosed region and separated therefrom by said latch, said line catch means permitting one-way entry to said second enclosed region when a force is applied thereto from outside of said second enclosed region; and line release means coupled to said jaw means for (i) moving said jaw means to said fully open position to thereby open said first enclosed region and said second enclosed region, and (ii) returning said jaw means to said partially open position from said fully open position.

7. A line retrieve-release system as in claim 6 further comprising a locking mechanism for locking said jaw means in said partially open position, said line release means further coupled to said locking mechanism for unlocking said jaw means from said partially open position prior to moving said jaw means to said fully open position.

8. A line retrieve-release system mounted on a hull of a boat, comprising:

a housing coupled to the hull;

an arm pivotally coupled to said housing and capable of counter-clockwise rotational movement between (i) a first position in which said arm points substantially aft relative to the bow of the boat, and (ii) a second position in which said arm is angularly displaced from said first position;

a latch coupled to said housing and biased to cooperate with said arm in said first position to thereby define a first enclosed region bounded by said arm and said latch, said latch permitting one-way entry to said first enclosed region when a force is applied to said latch from outside of said first enclosed region;

line catch means coupled to said housing aft of said arm, said line catch means cooperating with said arm in said first position to define a second enclosed region adjacent to said first enclosed region and separated therefrom by said latch, said line catch means permitting one-way entry to said second enclosed region when a force is applied thereto from outside of said second enclosed region; and actuator means coupled to said arm for generating, said counter-clockwise rotational movement to thereby open said first enclosed region and said second enclosed region.

9. A line retrieve-release system as in claim 8 wherein said actuator means includes a locking mechanism for locking said arm in said first position.

10. A line retrieve-release system as in claim 8 wherein said actuator means includes a return mechanism for returning said arm to said first position from said second position.

11. A line retrieve-release system as in claim 8 wherein said latch is spring-biased into cooperation with said arm.

12. A line retrieve-release system as in claim 8 wherein said line catch means comprises a paddle wheel rotationally coupled to said housing, said paddle wheel having a radial periphery defined by a plurality of spaced-apart paddle tips wherein, when one of said paddle tips cooperates with said arm as said paddle wheel rotates, said second enclosed region is thereby defined.

13. A line retrieve-release system as in claim 12 further comprising means for sensing when said paddle wheel is not rotating.

14. A line retrieve-release system as in claim 12 further comprising a deflector coupled to said housing and extending forward substantially toward the bow of the boat, said deflector adapted to direct an oncoming flow of water to a portion of said paddle tips to generate rotation of said paddle wheel in a counter-clockwise direction.

15. A line retrieve-release system as in claim 14 further comprising means coupled to said housing for permitting full rotation of said paddle wheel in said counter-clockwise direction and for permitting a partial rotation of said paddle wheel in a clockwise direction.

* * * * *